US006477809B1

(12) United States Patent
Dorner et al.

(10) Patent No.: US 6,477,809 B1
(45) Date of Patent: Nov. 12, 2002

(54) DEVICE FOR COVERING A GAP

(75) Inventors: Andreas Dorner, Hamburg (DE); Joachim Grage, Hamburg (DE); Uwe Willig, Norderstedt (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/914,693

(22) PCT Filed: Feb. 11, 2000

(86) PCT No.: PCT/DE00/00411

§ 371 (c)(1),
(2), (4) Date: Aug. 31, 2001

(87) PCT Pub. No.: WO00/52292

PCT Pub. Date: Sep. 8, 2000

(30) Foreign Application Priority Data

Mar. 2, 1999 (DE) ..... 199 08 970

(51) Int. Cl.[7] ..... E05D 11/00
(52) U.S. Cl. ..... 49/383
(58) Field of Search ..... 49/383; 16/250, 16/251, 225; 160/40

(56) References Cited

U.S. PATENT DOCUMENTS

| | | | | | |
|---|---|---|---|---|---|
| 2,641,792 | A | * | 6/1953 | Peeler | 49/383 |
| 2,910,741 | A | * | 11/1959 | Dettman | 49/383 |
| 3,302,690 | A | * | 2/1967 | Hurd | 16/250 |
| 4,040,142 | A | * | 8/1977 | Ippolito | 49/383 |
| 4,850,143 | A | | 7/1989 | Crooimans | |
| 5,001,862 | A | | 3/1991 | Albenda | |
| 5,220,708 | A | * | 6/1993 | Lucas et al. | 49/383 |
| 5,419,084 | A | * | 5/1995 | Sankey et al. | 49/383 |
| 6,141,909 | A | * | 11/2000 | Hanson | 49/383 |

FOREIGN PATENT DOCUMENTS

| | | | | |
|---|---|---|---|---|
| DE | 43 14 884 | | 11/1994 | |
| DE | 94 19 082 | | 3/1995 | |
| GB | 2218449 | * | 11/1989 | 49/383 |
| WO | 92/15763 | * | 9/1992 | 48/383 |

* cited by examiner

*Primary Examiner*—Jerry Redman
(74) *Attorney, Agent, or Firm*—Collard & Roe, P.C.

(57) ABSTRACT

The invention relates to a device for covering a gap, especially for providing a protective cover for the clearance between the door leaf and the door frame so as to avoid accidents. The novel flexible and strand-shaped gap covering profile is configured as a profiled body with a substantially tubular cross-section which comprises a front part, two lateral parts and two holding feet. The two lateral parts merge into a loop system that extends into the interior of the profiled body. The loop system in turn merges into the two holding feet at the outlet of the profiled body. The inventive loop system which has an essentially inversely symmetrical cross section in relation to the profile median that extends in the direction of the strand is configured in such a manner that the two lateral parts merge into a first loop that extends into the interior of the profiled body passing the holding foot or the holding element. The first loop merges into a respective second loop that merges into a mostly arcuate tapered part passing the inner side of the front part in a direction opposite to the first loop. The tapered part merges into the holding foot at the outlet of the profiled body.

14 Claims, 5 Drawing Sheets

DEVICE FOR COVERING A GAP

CROSS REFERENCE TO RELATED APPLICATIONS

Applicants claim priority under 35 U.S.C. §119 of GERMAN Application No. 199 08 970.1 filed on Mar. 2, 1999. Applicants also claim priority under 35 U.S.C. §120 of PCT/DE00/00411, filed on Feb. 11, 2000. The international application under PCT article 21(2) was not published in English.

DESCRIPTION

The invention relates to a device for covering a gap, comprising at least the following elements:

two abutting components that are separated from each other in their joint areas by a basic gap that is larger than 0 mm in most cases, whereby at least one component is displaceable, forming a gap that is enlarged versus the basic gap; and whereby, furthermore, at least one flexible profile covering the gap extends in the form of a strand and is secured on the two components and covers the gap;

whereby, furthermore, the components in particular are a door frame and/or a wall as well as a door leaf that is supported in a rotating manner, revolving around a center of rotation, notably forming a door gap that can be enlarged, whereby the zone of the door gap being farthest removed from the center of rotation is covered by a flexible profile covering the gap and extending in the form of a strand; and whereby, furthermore, at least one gap-covering profile, or the gap-covering profile being farthest removed from the center of rotation of a door with respect to the basic gap is a profiled body substantially that has a tubular cross sectional shape and comprises a front part, two lateral parts, as well as two holding feet, whereby the two side parts merge into a loop system extending into the interior of the profiled body; and whereby the loop system in turn merges into the two holding feet in the site of the outlet of the profiled body, said holding feet each being secured on the components by means of an additional holding element (DE-U-94 19 082).

According to U.S. Pat. No. 5,001,862, the loop system with a substantially inversely symmetrical cross section is configured in such a way that the two side parts each merge into a first loop, which in turn extends into the interior of the profiled body, passing the holding foot or holding element, and then merges into a second loop that merges into a curved, tapered outlet, passing the inner side of the front part in the direction opposite to the first loop, said tapered part finally merging into the holding foot in the site of the outlet of the profiled body.

Displaceable gaps with large differences in the size of the gap pose substantial risks for accidents. It is necessary to especially mention in this connection the door gaps in kindergardens, schools and where ever children are at play, where dangerous crush injuries occur time and again. It already has been proposed for that reason to cover such door gaps with profiles that have a cross section of the profile similar to an accordion. However, such profiles are frequently worn after only a short time of use because they were not capable of withstanding the partly extreme gap situations. The same problem was posed with the gap-covering profile according to DE-U-94 19 082 and U.S. Pat. No. 5,001,862.

Now, the problem of the present invention consists in providing a device for covering gaps arrangement for covering such gaps for systems that assures effective protection, in particular protection for fingers in different space and gap situations, whereby longer durability and less resetting force have to be connected with the geometry of the profile.

Said problem is solved according to the characteristic part of claim 17 by a system for covering a gap in connection with which the front part of the gap covering arrangement, at a substantially mirror-symmetrical cross-sectional shape in comparison to the loop system of the gap covering arrangement, has a thickening, whereby within the thickening there exists at least a strand-like extending hollow space.

Useful variations of the gap-covering arrangement as defined by the invention are specified in claims 2 to 16.

The invention is explained in greater detail in the following with the help of exemplified embodiment and by reference to schematic drawings, in which:

FIG. 1 shows a cross section through the gap-covering profile.

FIG. 2 shown an exemplified embodiment of a gap-covering system in the corner area of a door frame, with the door closed.

Figure 1:
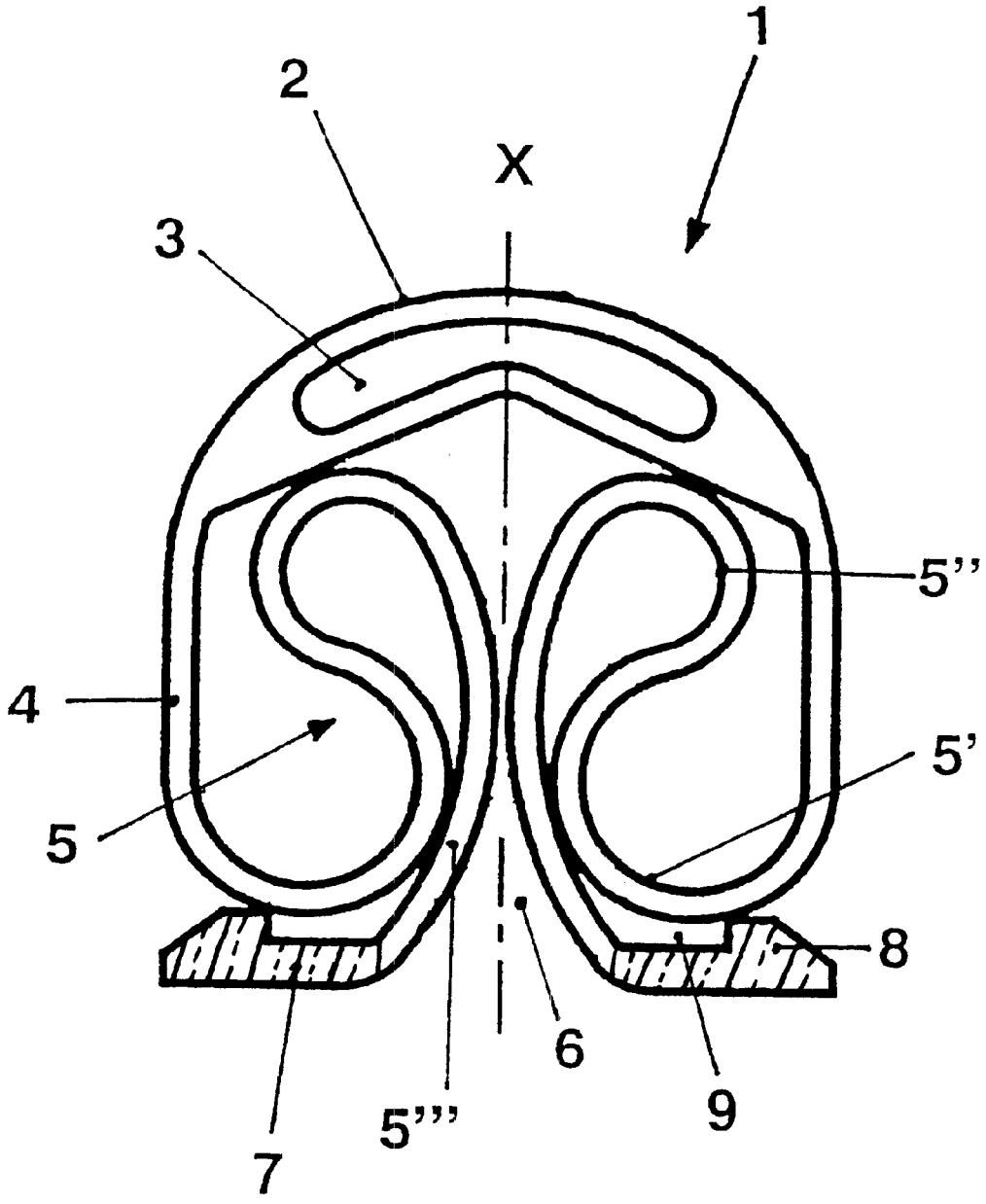

The following list of reference symbols applies in conjunction with the above figures:

I Arrangement covering the gap
II Arrangement covering the gap
1 Profile covering the gap
2 Front part
3 Cavity within the front part
4 Side part
5 Loop system
5' First loop
5" Second loop
5'" Curved tapered part
6 Tapered outlet site
7 Holding foot
8 Flange-shaped widening
9 Deepening
10 Corner area of door frame and wall
11 Door frame
12 Wall
13 Door
14 Holding element
15 Clamping strip
16 Screw
17 Gap-covering profile
18 Door frame
19 Door
20 Door or door frame guide
$S_0$ Door gap/basic gap (with the door closed)
$S_1$ Door gap (with the door open)
A Range of door gap
B Range of door gap
D Center of rotation of door
X Median plane of profile.

Figure 4:
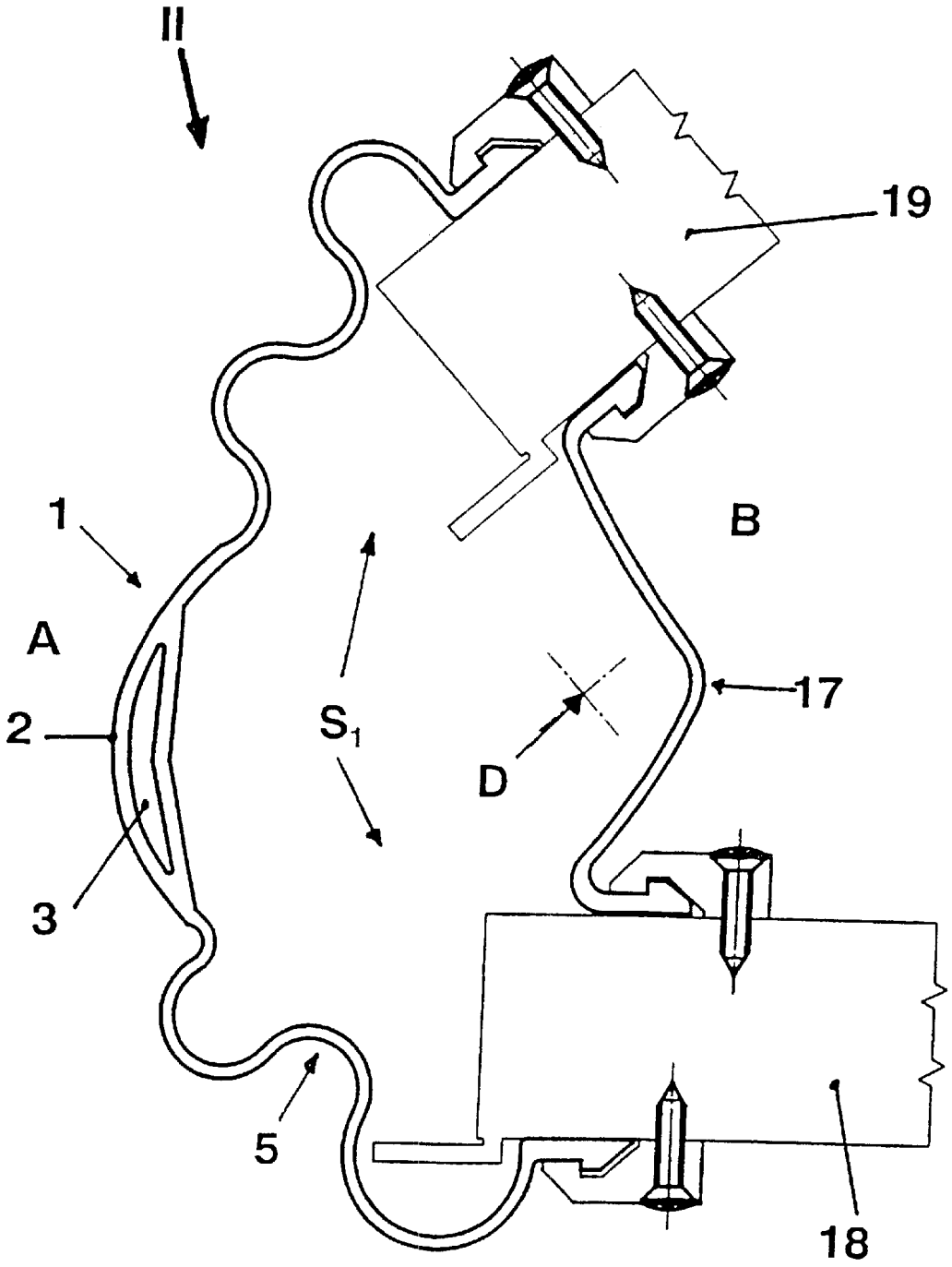
FIG. 4 shows a gap-covering system according to FIG. 3, with the door open.

According to FIG. 1, the flexible gap-covering profile is a profiled body having a substantially tubular cross sectional form and comprising a front part 2, the two side parts 4, as well as the two holding feet 7, whereby the two side parts merge into a loop system 5 that extends into the interior of the profiled body; and whereby in the tapered outlet site 6 of the profiled body, the loop system in turn merges into the two holding feet. The loop system is configured in connection with a substantially inversely symmetrical cross-section shape—based on the median plane X of the profile extending in the direction of the strand—in such a way that the two side parts 4 each merge into a first loop 5', which passes the holding foot 7 and in turn merges into the interior of the profiled body, and then merges into a second loop 5" that merges into a curved tapered part 5'", passing the inner side of the front part in the direction opposite to the first loop, and whereby said tapered part finally merges into the holding foot in the site of the outlet 6 of the profiled body. The special way in which said loop system is arranged, permits forming relatively large loops in a relatively small space. This reduces the inner stresses and the resetting forces that prevent the door from hitting back (FIG. 4). Furthermore, in conjunction with a substantially inversely symmetrical cross-sectional form based on the median plane X of the profile in the present case as well, the front part 2 has a thickening as compared to the loop system, whereby a cavity 3 is present within said thickening, said cavity extending in the form of a strand. Furthermore, the holding feet 7 have a flange-shaped widening on their ends, such a widening forming a deepening 9 extending in the form of strand for receiving a holding element, which is described in greater detail in the following in conjunction with FIG. 2.

The gap-covering profile 1 consists of an elastomer material, in particular of EPDM, a thermoplastic elastomer, in the present case especially TPE-V or TPE-U, or of a thermoplastic, particularly PVC in the present case. The TPE-V materials include thermoplastic olefins with a cross-linked elastomer phase. A TPE-U, on the other hand, is a polyurethane block copolymer. It is possible also with such materials to provide the gap-covering profile with color.

It is advantageous in special cases of application if the gap-covering profile 1 is made of a polymer material that is difficult to ignite, resistant to ozone and UV-light, as well as permanently elastic within a thermal range of use from −40° C. to 130° C.

The gap-covering profile 1 is in most cases an extruded product consisting of a uniform material. A co-extruded product, in which the holding feet 7 consist of a harder material than the other components of the gap-covering profile, as shown in FIG. 1, can be used as well.

Furthermore, it is advantageous if a gap-covering profile 1 is used that has already been provided with the loop system in the course of its extrusion.

Figure 2:
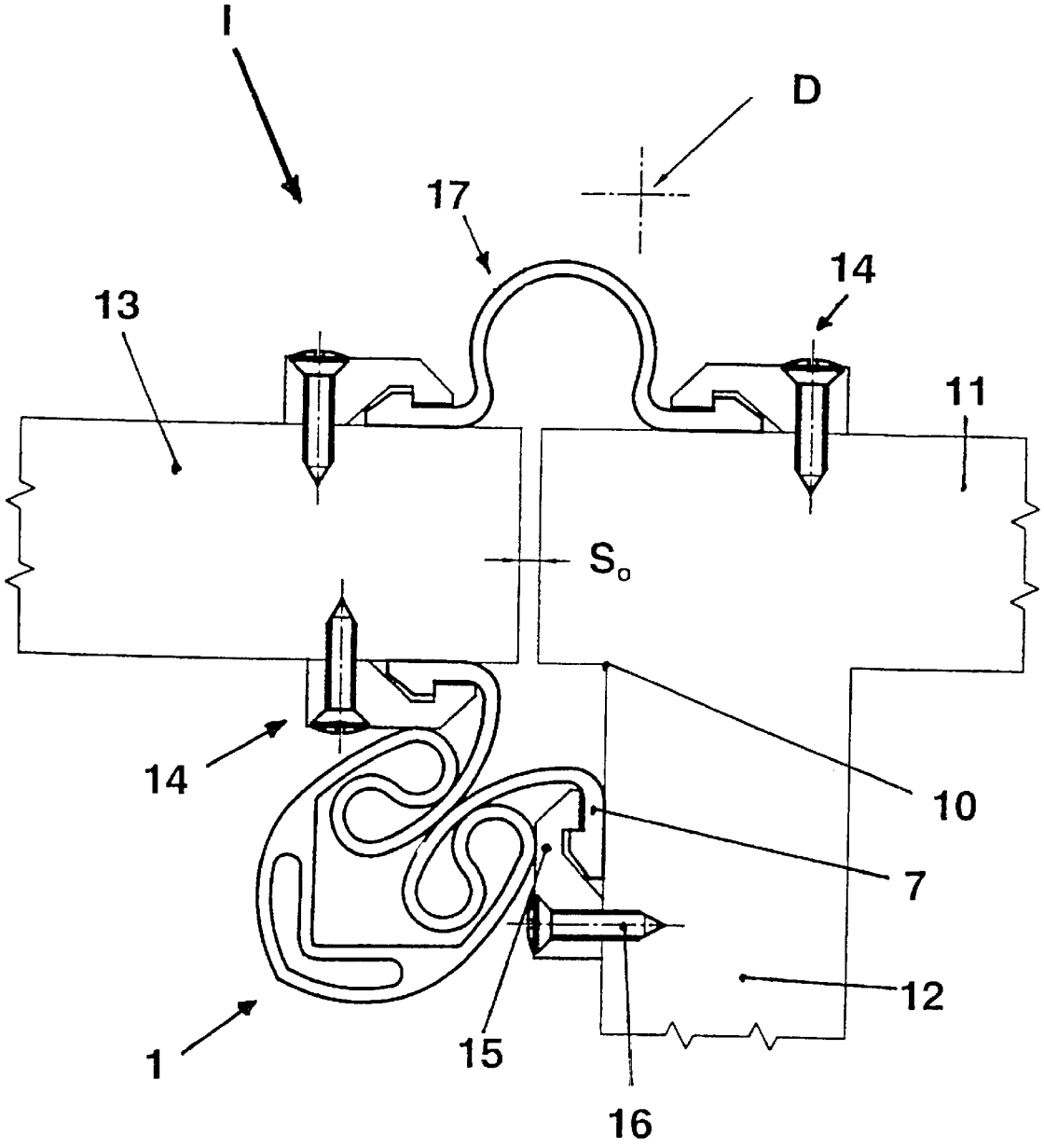

Now, FIG. 2 shows a frequently found gap-covering arrangement I. A door gap $S_0$ (the basic gap) is present between the closed door 13 and the frame 11, the latter forming jointly with a wall 12 a corner zone. The gap-covering profile 1, which covers the area of the door gap that is farthest removed from the center of rotation D, is secured in this connection on the wall 12, on the one hand, and on the door 13 on the other. The holding feet 7 are secured in this connection on the respective components by means of a holding element 14 in the form of the clamping strips 15 made of metal, plastic or wood, using the screws 16, or by means of gluing. The profile, which has an overall slim structure, and the holding feet 7, which are relatively close to one another, facilitate the installation because of their low space requirements.

The area of the door gap disposed closest to the center of rotation D is covered by a commercially available profiled body 17 that may be made of the same materials as those used for the gap-covering profile 1, notably with application of the fastening principle.

Figure 3:
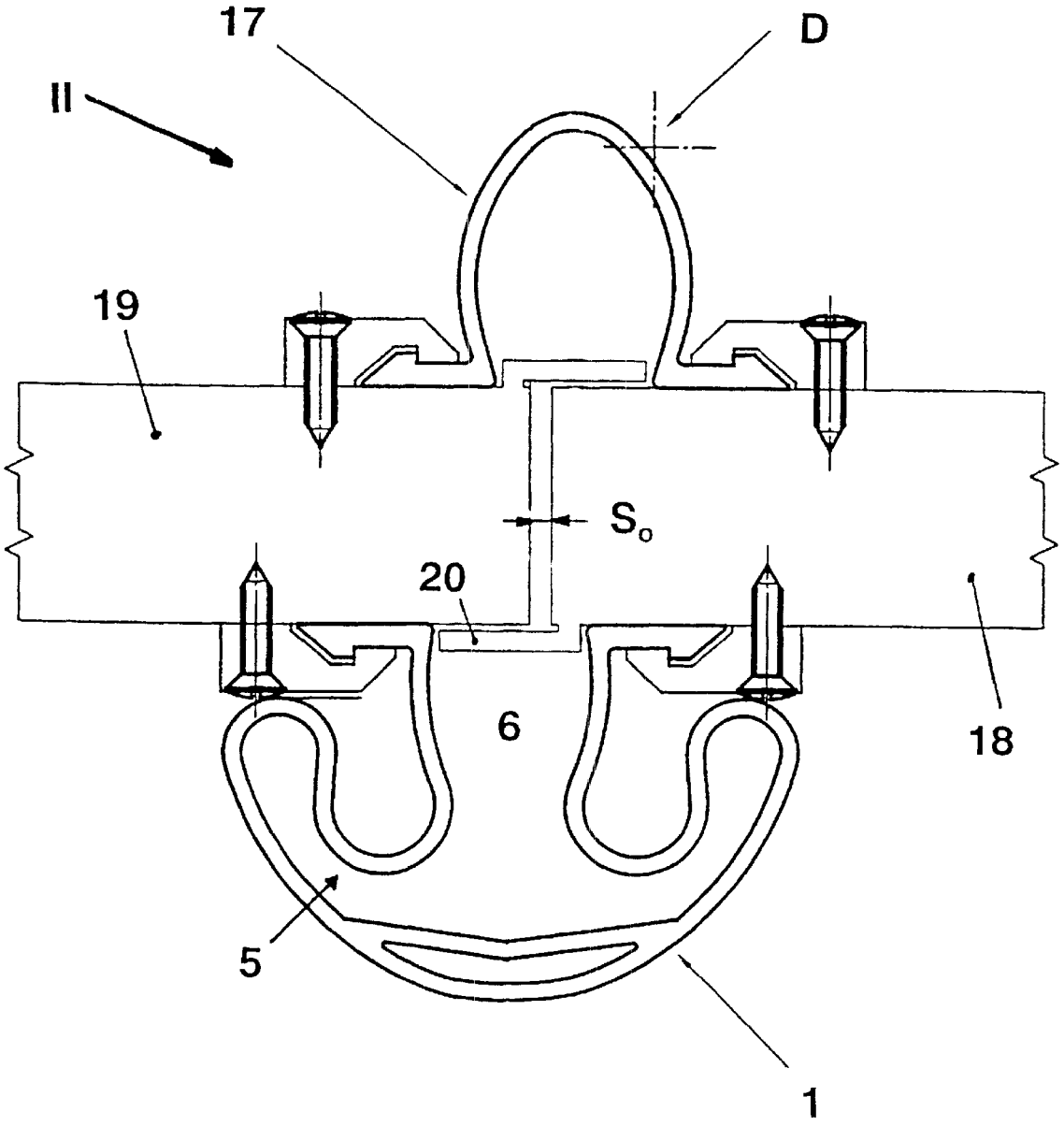
FIG. 3 shows another exemplified embodiment of a gap-covering system, with the door closed.

FIG. 3 shows another frequently used gap-covering arrangement II located outside of the corner area of a room. A door gap $S_0$ (the basic gap) is present between the closed door leaf 19 and the door frame 19, said door gap being covered on both sides by the profiled body. The gap-covering profile 1 is farthest removed from the center of rotation D in the present case as well. Conditioned by the door leaf or door frame guide 20, the lop system 5 is already no longer in contact with said guide within the zone of the outlet 6, as opposed to the exemplified embodiment according to FIG. 2.

Based on the same gap-covering arrangement II according to FIG. 3, FIG. 4 shows the door 19 in the open condition, forming a door gap $S_1$ that has grown larger. Now, within the door gap range A with the greatest spacing of the gap, the loop system 5 of the gap-covering profile 1 acts in an optimal manner, with adaptation to the gap situation. The geometry of the profile has changed in this connection, forming a now substantially wave-shaped cross sectional shape. The special construction of the front side 2 with the integrated cavity 3, which is located in about the center of the door gap S1 when the door is open, makes it more difficult to press the door into the door gap, from which results increased protection against jamming. Furthermore, as the gap-covering profile 1 can be easily deformed when stressed horizontally, closing of the door cannot be obstructed if the profile is compressed in any way.

Since the extreme situation of the gap does not exist within the door gap range B, it is possible in the present case to make do with a commercially available profiled body 17 without a loop system. However, with extreme gap situations, it is advantageous to use the gap-covering profile 1 within the door gap range B as well.

Figure 5:
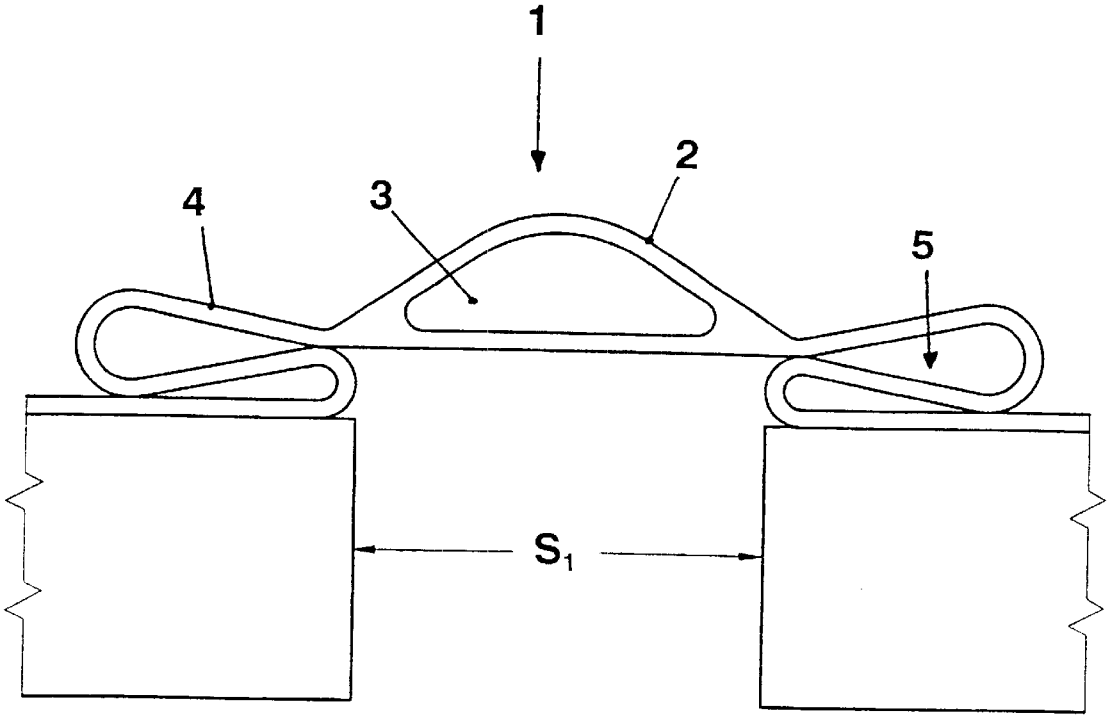
FIG. 5 shows a cross section through the gap-covering profile in the critical area.

Now, FIG. 5 shows the geometry of the gap-covering profile 1 in the critical range with a gap $S_1$ of about 2 to 5 cm. The loop system 5 is arranged in this connection in such a way that a reinforcement of the wall of the gap-covering profile occurs. The reinforcement of the wall is caused on account of the fact that the loop system rests closely against the side part 4 (FIG. 1) in the present case. The shape of the front part 2 with its cavity 3 comes to bear particularly effectively under the present circumstances. An additional protection against jamming is effected in this manner in the critical gap range because the gap-covering profile is not pressed into the gap.

Even though the principal purpose of application of the gap-covering profile 1 has to be seen in the protective bridging of door gaps for protecting fingers, said concept can be realized also for covering technical gaps, for example in connection with smoke protection flaps, loading hatches, as well as where ever bridges of cold, influence of light and corrosion have to be avoided.

What is claimed is:

1. An arrangement (I, II) for covering a gap comprising at least two abutting components that are separated from each other at their joints by a gap, whereby at least one component is movable notably to enlarge the gap; whereby, furthermore, at least one flexible gap-covering profile extending in the form of a strand covers the gap, said profile being secured on the two components;

whereby in particular the components are a door frame (11, 18) and/or a wall (12) as well as a door (13, 19) supported in a rotating manner rotating about a center of rotation (D), notably with formation of a door gap, that can be enlarged, whereby at least a door gap range (A) farthest removed from the center of rotation (D) is covered by a flexible gap-covering profile (1) extending in the form of a strand; whereby, furthermore, said at least one gap-covering profile is a profiled body with a substantially tubular cross sectional shape and comprises a front part (2), two side parts (4) as well as two holding feet (7), whereby the two side parts merge into a loop system (5) extending into the interior of the profiled body, whereby the loop system in turn merges into the two holding feet in a site of an outlet (6) of the profiled body; said two holding feet each being secured on the components by means of an additional holding element (14); whereby additionally the loop system (5), in conjunction with a substantially inversely symmetrical cross sectional shape based on the median plane (X) of the gap-covering profile extending in the direction of the strand, is configured in such a way that the two side parts (4) each merge into a first loop (5'), which in turn extends into the interior of the profiled body, passing one of said two holding feet (7) or the holding element (14), and then merges into a second loop (5"), which merges into a mostly curved, tapered part (5'"), passing the inner side of the front part (2) in the direction opposite to the first loop, and said tapered part finally merges into said one of said two holding feet in the site of the outlet (6) of the profiled body;

characterized in that the front part (2) of the gap-covering profile (1), in conjunction with a substantially inversely symmetrical cross section based on the median plane (X) of the profile extending in the direction of the strand, has a thickening as compared to the loop system (5) of the gap-covering profile, whereby at least one cavity (3) extending in the form of a strand is present within the thickening.

2. The gap-covering arrangement according to claim 1, characterized in that the gap-covering profile (1) consists of an elastomeric material.

3. The gap-covering arrangement according to claim 1, characterized in that the gap-covering profile (1) consists of a thermoplastic elastomer (TPE).

4. The gap-covering arrangement according to claim 1, characterized in that the gap-covering profile (1) consists of a thermoplastic material.

5. The gap-covering arrangement according to claim 1, characterized in that the gap-covering profile (1) is made of a polymer material that is flame-retardant, resistant to ozone and UV-light, as well as permanently elastic in a thermal range of from −40° C. to 130° C.

6. The gap-covering arrangement according claim 1, characterized in that the gap-covering profile (1) is an extruded product made of a uniform material.

7. The gap-covering arrangement according to claim 1, characterized in that the gap-covering profile (1) is a co-extruded product in which the holding feet (7) consist of a harder material than the other parts of the gap-covering profile.

8. The gap-covering arrangement according to claim 1, characterized in that a gap-covering profile (1) is used that is already provided with the loop system (5) in the course of its manufacture by extrusion.

9. The gap-covering arrangement according to claim 1, characterized in that the holding feet (7) have a flange-shaped widening (a) at their ends, notably with formation of a deepening (9) extending in the form of a strand for receiving the holding element (14).

10. The gap-covering arrangement according to claim 1, characterized in that the holding feet (7) are secured on the components by means selected from the group consisting of a holding element (14) in the form of metal, plastic or wood clamping strips (15), screws (16) and gluing.

11. The gap-covering arrangement according to claim 1, characterized in that exclusively the door gap area (A) farthest removed from the center of rotation (D) is covered by the gap-covering profile (1) which contains the loop system (5), whereas the door gap area (B) disposed closest to the center of rotation (D) is covered by means of a covering profile (17) without a loop system.

12. The gap-covering arrangement according to claim 11, characterized in that the gap-covering profile (1) without a loop system is made of the same material as the gap-covering profile (1).

13. The gap-covering arrangement according to claim 1, characterized in that both the door gap area (B) disposed farthest removed from the center of rotation (D) and the door gap area (A) disposed closest to the center of rotation (D) are covered by the gap-covering profile (1) which contains the loop system (5).

14. The gap-covering arrangement according to claim 1, characterized in that the loop system (5) is arranged in a critical zone with a gap ($S_1$) of about 2 to 5 cm in such a way that a reinforcement of the wall of the gap-covering profile (1) occurs, whereby the loop system tightly abuts the side part (4).

* * * * *